United States Patent [19]

Jertberg et al.

[11] Patent Number: 4,945,698

[45] Date of Patent: Aug. 7, 1990

[54] ADJUSTABLE SCREED SUPPORT

[75] Inventors: Jeffrey R. Jertberg, La Jolla; Robert M. Jertberg, San Diego; Martin vanDinteren, El Cajon, all of

[73] Assignee: Vanberg Enterprises, San Diego, Calif.

[21] Appl. No.: 390,929

[22] Filed: Aug. 7, 1989

[51] Int. Cl.[5] ..... E04F 13/06

[52] U.S. Cl. ..... 52/365; 52/372; 52/364

[58] Field of Search ..... 52/364, 365, 372, 732, 52/367, 368, 370, 371

[56] References Cited

U.S. PATENT DOCUMENTS

| | | | |
|---|---|---|---|
| 1,191,871 | 7/1916 | Carrick | 52/367 X |
| 1,610,180 | 11/1926 | Thomson | 52/365 X |
| 1,762,254 | 6/1930 | Zarba | 52/371 |
| 2,025,576 | 12/1935 | De Spirt | 52/365 |

FOREIGN PATENT DOCUMENTS 1180112 10/1964 Fed. Rep. of Germany .

*Primary Examiner*—Carl D. Friedman
*Assistant Examiner*—Linda J. Hoffert
*Attorney, Agent, or Firm*—Calif Kip Tervo

[57] ABSTRACT

An adjustable screed support for supporting one end of a screed during screeding of cement on a wall generally comprises a support bracket for attachment to the wall support structure including a stand-off portion extending outward, away from the wall support structure; and an elongate beam which is adjustably attached to the support bracket stand-off such that the distance of the top side of the beam from the wall support structure and the angle of the line of the beam the wall support structure are variable. The beam top side in side view is a straight line. The beam has holes side to side through its web portion and the support bracket stand-off portion has conguent holes. Cement from each side of the screed support flows through the holes and bonds to the cement on the other side.

4 Claims, 1 Drawing Sheet

ADJUSTABLE SCREED SUPPORT

BACKGROUND OF THE INVENTION

1. Field of the Invention

This invention relates in general to the leveling of cement on walls and more specifically to a device for supporting a screed during the striking off of the cement.

2. Description of the Related Art

Cementing is a common manner of forming and/or covering a surface, such as a wall. A screed is drawn over the un-cured cement to form the outer surface plane of cement. During this leveling or striking off, the screed is supported toward its outer ends. Often the cement plane is covered with tiles.

It is desirable that the outer surface of cement applied to the wall be flat, i.e. that it be a plane, so that tiles or other coverings may be attached to it. Often it is also desirable that the cement plane be at an particular angle relative to some datum. For example, it may be desirable that a bathtub wall be vertical and, also, that it be at right angles to the adjoining walls. If the surface to be covered is generally horizontal, then it may be desirable for the cement plane to be slightly slanted to provide for run-off.

One conventional method of forming the cement plane on a wall is to apply a scratch coat of cement and allow it to cure for a few days. A typical scratch coat is comprised of three parts sand and one part plastic cement and is about three-eighths inches thick.

After the scratch coat has cured, screed support sticks are mounted on the wall by first applying vertical elongate mounds of brown coat cement to the scratch coat. Each mound supports a screed support stick. Typically, two mounds are applied, each about five-eighths inches thick and running from the top to the bottom of the wall. Before the mound cement has completely cured, a screed support stick is stuck into the cement. A stick is commonly a piece of wood cut the height of the wall and three-quarters inches wide and one-eighth or one-quarter inches thick.

The sticks are adjusted in the cement to bring them into plumb. The mounds are allowed to cure.

A brown coat is applied to the remainder of the wall up to the level of the top of the sticks. A screed is rested on the sticks and is used to strike off excess cement and to form the outer plane surface of the cement. The brown coat is cured.

The sticks are removed and holes created thereby are filled in with brown coat cement.

There are a number of disadvantages to this prior art method of supporting a screed. Obviously, it is very time consuming. Particularly, the stick mounds must be built and cured. It is often difficult to properly align the sticks in the cement. The sticks must be removed, their holes fillted in, and more time is required waiting for this fill cement to dry.

Additionally, this method requires skill on the part of the installer. Setting the sticks in the cement is an art. The cement must be soft, but not too soft. The sticks may move after placement or even fall out. Upon pressure of screeding, sticks may bow or move.

It is particularly difficult to adjust sticks on adjoining walls such that the walls are planes that intersect at a right angle. This results because the cement hardens in the time required to align everthing and the depth of the sticks must be changed.

Therefore, it is desirable to have a screed supporting device that is easily mounted, that is easily brought into plumb, that may be adjusted height-wise so as to align adjoining walls, and that decreases the total construction time.

SUMMARY OF THE INVENTION

According to the invention, an adjustable screed support for supporting one end of a screed during screeding of cement on a wall generally comprises: a support bracket for attachment to the wall support structure including a stand-off portion extending outward, away from the wall support structure; and an elongate beam which is adjustably attached to the support bracket stand-off such that the distance of the top side of the beam from the wall support structure and the angle of the line of the beam top side relative to said wall support structure are variable.

The beam top side in side view is a straight line. The beam has holes side to side through its web portion and the support bracket stand-off portion has conguent hole. Cement from each side of the screed support flows through the holes and bonds to the cement on the other side.

Other features and many attendant advantages of the invention will become apparent upon a reading of the following detailed description together with the drawing, in which like reference numerals refer to like parts throughout.

The drawings disclose by way of example, and not by way of limitation, the principles of the invention and the structural implementations of the inventive concept.

DETAILED DESCRIPTION OF THE INVENTION

Figure 1:
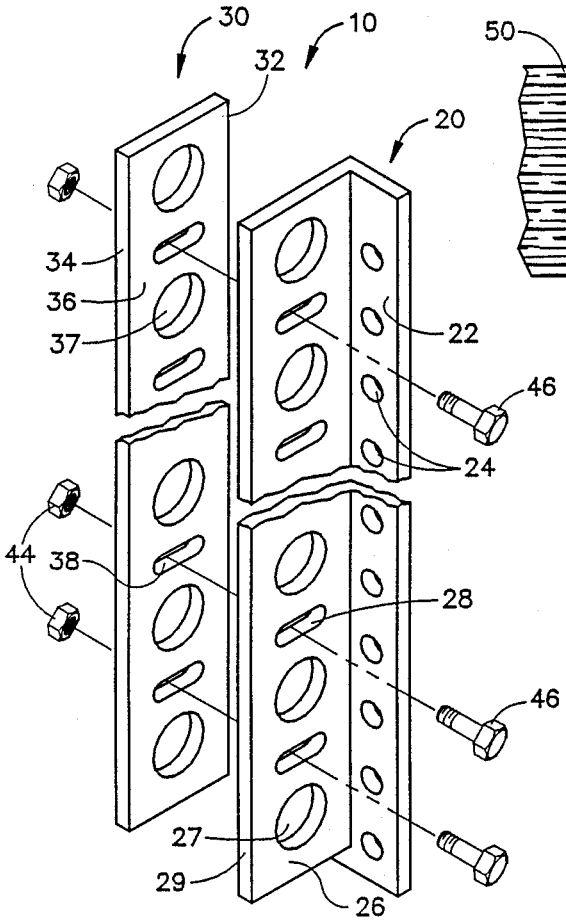
FIG. 1 is an exploded perspective view of a preferred embodiment of the adjustable screed support of the present invention.

With reference now to the drawing, and more particularly to FIG. 1 thereof, there is shown a preferred embodiment of the adjustable screed support, denoted generally as 10, of the present invention.

Screed support 10 generally comprises a support bracket means, such as angle 20, for attachment to a wall support member, beam 30, and adjustable attachment means, including nuts 44 and bolts 46, for attaching beam 30 to angle 20.

Angle 20 includes a base 22 having means, such as screw holes 24, for attaching the base 22 to a wall support member. Angle 20 includes stand-off portion means 26 for extending outward from the attached wall support member. Stand-off portion 26 includes a plurality of slots 28 and holes 27. Preferably, the top side 29 of stand-off portion 26 is a straight line in side view. Angle 20 is constructed of strong, rigid, non-rusting material, such as aluminum or galvanized steel. For construction of a standard bathroom wall, an angle 20 of three-quarter inch aluminum one-sixteenth inch thick has been found satisfactory.

Beam 30 has a bottom side 32 facing the wall support member and a top side 34 facing away from the wall support member. Beam top side 34 is a straight line when viewed from the side. Web 36 joins and separates top side 32 and bottom side 34. Web 36 has a plurality of holes 37 and slots 38 therethrough. Beam 30 is attached to the outside of angle 20 such that beam holes 37 and slots 38 align with angle holes 27 and slots 28. Beam 30 is constructed of strong, rigid, non-rusting material, such as aluminum. For a typical bathroom wall, a beam 30 with a three-quarter inch web and a one-eighth inch width would be used with the angle 20 described above. Of course, angle 20, beam 30, and their attachment pieces 44,46 should not be of dis-similar metals or electrolysis may occur.

Adjustable attachment means include bolts 46 for passing through slots 28,38 and nuts 44 for allowing beam top side 34 to be adjustably positioned away from the wall support member and for adjusting the relative angle of the beam top side 34 to the wall support member.

Figure 3:
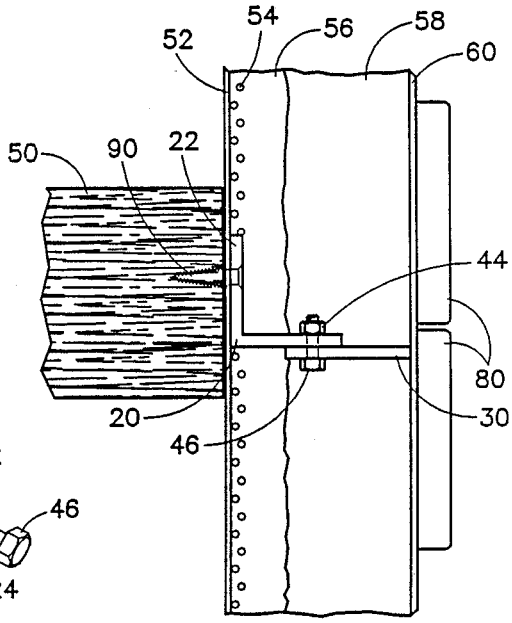
FIG. 3 is a top plan view of FIG. 2.
Figure 2:
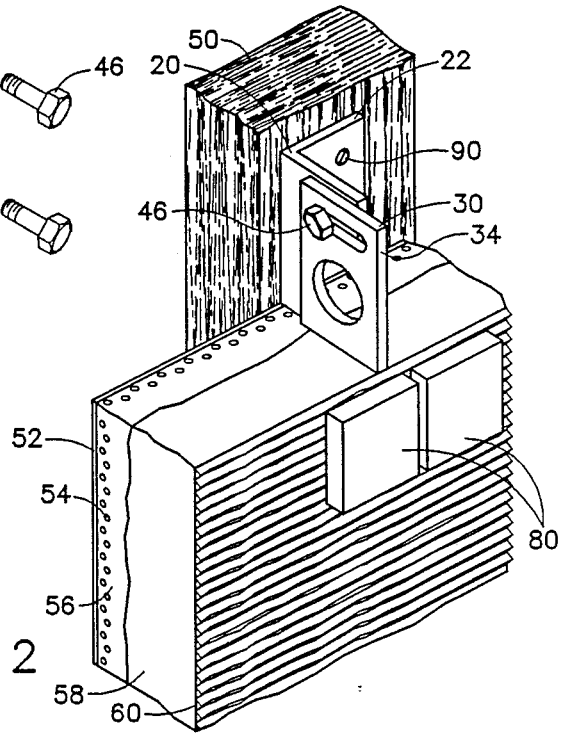
FIG. 2 is a perspective view, partially cut away, of the screed support as used and left imbedded in a cemented wall.

Turning now to FIGS. 2 and 3, there is shown the screed support 10 as installed in a typical installation configuration in a cemented wall. FIG. 2 is a perspective view, partially cut away, of screed support 10 embedded in a cemented wall. FIG. 3 is a top cross-sectional view of FIG. 2.

Wall support members, such as two-by-four 50, provide the support structure for construction of the cement wall. The wall support members may be spaced two-by-fours, as shown, as is common in new installations, or may be a continuous support, such as a sheet of plywood.

The wall to be cemented is covered with oil paper 52 by attaching it to the two-by-fours 50. Next, the wall is covered with a layer of wire mesh 54 attached to the two-by-fours. Wire mesh 54 adds strength and retains cement in position even if it is damaged.

A screed support 10 is attached to two-by-four 50 near one end of the wall for supporting one end of the screed. The attachment may by any suitable means, such as wood screws 90, one of which is shown, through screw holes 24 in base 22. The other of the pair of screed supports is attached near the other end of the wall for supporting the other end of the screed. A pair of the nuts and bolts 44,46 should be lightly holding beam 30 in the fully lowered position, i.e. with beam top side 34 as close to the wall support as possible. Of course, beam top side 34 must be even with or extend out past the stand-off top side 29.

Each beam top side is leveled by using a plumb or level. Preferably, this is done with beam 30 in the fully down, i.e. toward the wall, position. If the beam needs to be adjusted, nuts and bolts 44,46 are loosened sufficiently so that beam 30 can be brought into alignment with the level or plumb and then tightened. The beam of the other support is similarly adjusted.

The adjustable screed supports may be adjusted such that the finished wall is out of plumb if that is desired. For example, a horizontal wall surface may be given a desired slant for the run off of water or the like in a direction parallel to the beams by adjusting the angle of each beam. Or by running a straight edge between the two beams, a beam may be raised or lowered uniformly such that water on the finished wall runs perpendicular to the beams. This method can be used on a vertical wall to bring one wall into square with an adjoining wall with which it is slightly out of square.

A large square can also be used to bring adjoining walls into square. Adjustable screed supports are attached to both walls to be cemented. The square will indicate which of the beams may be moved uniformly outward so that the finished walls are at right angles to one another.

With beam 30 in proper position, the attaching nuts and bolts 44,46 are tightened so that there is no further movement in the beam.

A first coat of cement, scratch coat 56, of approximately three-eighths inch thick, is applied to the wall and cured. Then a second coat of cement, brown coat 58, of approximately five-eighths inch thick, is applied to a height of slightly higher than beam top side 34. The beam top sides 34 are now used to support a screed during the leveling or striking off of brown coat 58.

Cement passes through holes 27,37 and slots 28,38 so that the cement on each side of screed support 10 is bonded to the cement on the other side.

Tiles 80 are attached to the leveled surface by applying a thin set of glue 60 with a knotched trowel.

Although the invention has been shown and described with respect to use with a wall; wall, as used in the appended claims, is defined to include any similar surface, be it horizontal, vertical, or slanted.

Having described the preferred embodiment of the present invention, many alterations and modifications which are within the scope of the inventive concepts as disclosed herein will likely occur to those skilled in the art. It is to be understood that all matter herein is to be interpreted as illustrative and not in any limiting sense, and it is intended to cover in the appended claims such modifications and changes as come within the true spirit and scope of the invention.

In the description and in the claims, the word "wall" is defined to include any planar surface regardless of the vertical or horizontal orientation of the surface.

I claim:

1. An adjustable screed support for supporting one end of a screed during screeding of cement on a wall; the wall having a support structure; said adjustable screed support comprising:

support bracket means for attachment to the wall support structure including stand-off means extending outward, away from the wall support structure; and an elongate beam having:

a bottom side toward the wall;

a top side away from the wall; said beam top side in side view being a straight line; and a web joining and separating said top side and said bottom side;

said beam being adjustably attached to said support bracket stand-off such that the distance of said top side from the wall support structure and the angle of the line of said top side relative to said wall support structure are variable.

2. The adjustable screed support of claim 1 wherein: said elongate beam web has a plurality of holes passing therethrough such that cement can flow through.

3. The adjustable screed support of claim 2 wherein: said support bracket stand-off means has holes passing from side to side therethrough; said stand-off holes overlapping said web holes such that cement can flow through.

4. A method of preparing a wall for cementing and striking off; said wall having a wall support structure; said method including the steps of:

attaching a pair of adjustable screed supports to the wall support structure; each screed support for supporting one end of a screed during striking off;

each screed support including:

support bracket means for attachment to the wall support structure including stand-off means extending outward, away. from the wall support structure; and an elongate beam having:

a bottom side toward the wall;

a top side away from the wall; said beam top side in side view being a straight line; and a web joining and separating said top and said bottom;

said beam being adjustably attached to said support bracket stand-off such that the distance of said top side from the wall surface structure and the angle of said top side relative to said wall support structure are variable; and adjusting the beam of each screed support according to a plum or level.

* * * * *